US009700075B2

(12) United States Patent
Liu

(10) Patent No.: US 9,700,075 B2
(45) Date of Patent: Jul. 11, 2017

(54) LEAKAGE PREVENTION STRUCTURE FOR AN ELECTRONIC CIGARETTE AND ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 882 days.

(21) Appl. No.: 14/026,566

(22) Filed: Sep. 13, 2013

(65) Prior Publication Data

US 2015/0020826 A1 Jan. 22, 2015

(30) Foreign Application Priority Data

Jul. 16, 2013 (CN) ..... 2013 2 0422810 U

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2013/0042865 A1* 2/2013 Monsees ..... A61M 15/06 128/203.27
2013/0192617 A1* 8/2013 Thompson ..... A24F 47/008 131/329
2015/0034104 A1* 2/2015 Zhou ..... A24F 47/008 131/329

* cited by examiner

*Primary Examiner* — Michael H Wilson
*Assistant Examiner* — Katherine Will
(74) *Attorney, Agent, or Firm* — Tim Tingkang Xia, Esq.; Locke Lord LLP

(57) ABSTRACT

An electronic cigarette is provided, comprising a case, an atomizer seat, and a battery, both the atomizer seat and the battery accommodated in the case, the atomizer seat defining a first through hole; wherein, a bracket and a sealing component corresponding to the bracket are mounted between the atomizer seat and the battery, an extension part corresponding to the first through hole is formed at one side of the bracket facing the atomizer seat, the extension part is inserted in the first through hole to prevent the atomizer seat and the sealing component from leaning, and the sealing component is sleeved in the case and cooperates with an inner surface of the case to form interference fit.

11 Claims, 7 Drawing Sheets

LEAKAGE PREVENTION STRUCTURE FOR AN ELECTRONIC CIGARETTE AND ELECTRONIC CIGARETTE

CROSS-REFERENCE TO RELATED APPLICATION

This application claims priority of application No. 201320422810.7, filed on Jul. 16, 2013 in the Intellectual Property Office of The Republic of China, which is incorporated by reference herein in its entirety.

FIELD OF THE INVENTION

The present invention relates to the field of electrical products, and more particularly, relates to an electronic cigarette.

BACKGROUND OF THE INVENTION

Electronic cigarettes are substitutes of cigarettes. Electronic cigarettes can simulate the taste of cigarettes, but smoking electronic cigarettes does not generate harmful tar, nicotine and second-hand smoke. Therefore, electronic cigarettes can improve smoking cessation success rate of nicotine replacement therapy. A conventional electronic cigarette generally comprises two parts, wherein one part is an electronic cigarette rod simulating a cigarette rod, and includes a smoke sensor and a battery circuit received therein; and the other part is an atomizer connected with the electronic cigarette rod, the atomizer comprises an oil reservoir provided with air holes, fiber cotton, and a heating wire. The fiber cotton coils around the heating wire, and the fiber cotton and the heating wire are accommodated in the oil reservoir together. The oil reservoir is filled with special tobacco tar, and the tobacco tar penetrates into the fiber cotton layer by layer. The heating wire can be electrified and then generates heat. When the heating wire generates heat, the heating wire can bake the oiled fiber cotton contacting therewith, so that the tobacco tar is volatilized and become smoke. The smoke is inhaled by a user via a suction nozzle, and an action of simulation of smoking is completed. However, in the prior art, the tobacco tar in the atomizers of the electronic cigarettes has a risk of penetrating into the electronic cigarette rods. Thus, the electronic cigarettes cannot achieve good effect of preventing tobacco tar leakage, and lives of batteries of the electronic cigarettes may be adversely affected.

SUMMARY OF THE INVENTION

The objective of the present invention is to provide an electronic cigarette which adopts double protection to prevent tobacco tar leakage and to be benefit to air circulation, aiming at the above-mentioned drawback that the electronic cigarettes in the prior art tend to leak tobacco tar.

The technical solutions of the present invention for solving the technical problems are as follows: an electronic cigarette, comprising a case, an atomizer seat, and a battery, both the atomizer seat and the battery accommodated in the case, the atomizer seat defining a first through hole; wherein, a bracket and a sealing component corresponding to the bracket are mounted between the atomizer seat and the battery, an extension part corresponding to the first through hole is formed at one side of the bracket facing the atomizer seat, the extension part is inserted in the first through hole to prevent the atomizer seat and the sealing component from leaning, and the sealing component is sleeved in the case and cooperates with an inner surface of the case to form interference fit.

Advantageously, a first annular flange and a second annular flange are separately formed on a periphery of the sealing component, the first annular flange is formed on a side of the sealing component that is close to the bracket, and the first annular flange and the second annular flange form interference fits with the case respectively.

Advantageously, a gap for air circulation is formed between the bracket and the case.

Advantageously, a clamping part is formed at one side of the bracket near the sealing component, a recess configured for accommodating the clamping part is defined in the sealing component, the clamping part is inserted in the recess, and the extension part is inserted in the first through hole, so that the atomizer seat, the bracket, and the sealing component are sequentially fixedly connected.

Advantageously, both the number of the clamping part and the number of the recess are two, the two clamping parts are symmetrically positioned relative to an axis of the extension part, and the recesses and the clamping parts are arranged in an one-to-one relationship.

Advantageously, the atomizer seat comprises a hollow atomizer seat body, an atomizer seat cap defining a first connection hole and covering on one end of the atomizer seat body, and a cylinder extending towards a direction that is away from the bracket along an edge of the first connection hole, a second connection hole is defined in the cylinder, and the first connection hole and the second connection hole are communicated to form the first through hole.

Advantageously, the atomizer seat cap further defines two wire holes, and the two wire holes are positioned on two opposite sides of the first connection hole respectively. Advantageously, a third annular flange and a fourth annular flange are separately formed on a periphery of the atomizer seat cap, and both the third annular flange and the fourth ring flange form interference fits with the case respectively.

Advantageously, the bracket comprises a hollow sleeve body and a sleeve cap covering on one end of the sleeve body, and the sleeve body defines grooves separately.

Advantageously, the extension part extends along an axis of the sleeve cap, and a second through hole for air circulation is defined in the side wall of the extension part.

Advantageously, an air inlet hole is defined in a portion of the case corresponding to the gap, and the air inlet hole, the gap, the grooves, the second through hole, and the first through hole are communicated to form a first air flow channel.

Advantageously, a length of the sleeve body is less than a length of the extension part.

Advantageously, a third through hole is defined in the sealing component, the extension part is a hollow cylinder, and the third through hole, the extension part, and the first through hole are communicated to form a second air flow channel.

Advantageously, the third through hole is positioned between the two recesses, and the third through hole and the extension part are set coaxially.

Advantageously, the bracket is made of plastic materials.

Advantageously, both the atomizer seat and the sealing component are made of soft rubber materials.

When implementing the electronic cigarette of the present invention, the following advantageous effects can be achieved: the two ends of the bracket are respectively inserted in the atomizer seat and the sealing component; after the assembly of the electronic cigarette is completed, the atomizer seat, the sealing component, and the bracket are combined into a whole, which increases the guiding length of the electronic cigarette. Furthermore, the bracket is made of hard materials, and thus can effectively prevent the atomizer seat and sealing component from leaning and achieve very good tobacco tar leak-proof effect. Additionally, both the atomizer seat and the sealing component form interference fits with the case respectively, which forms double protection to prevent tobacco tar leakage, avoids the occurrence of tobacco tar leakage, and improve users' experience.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
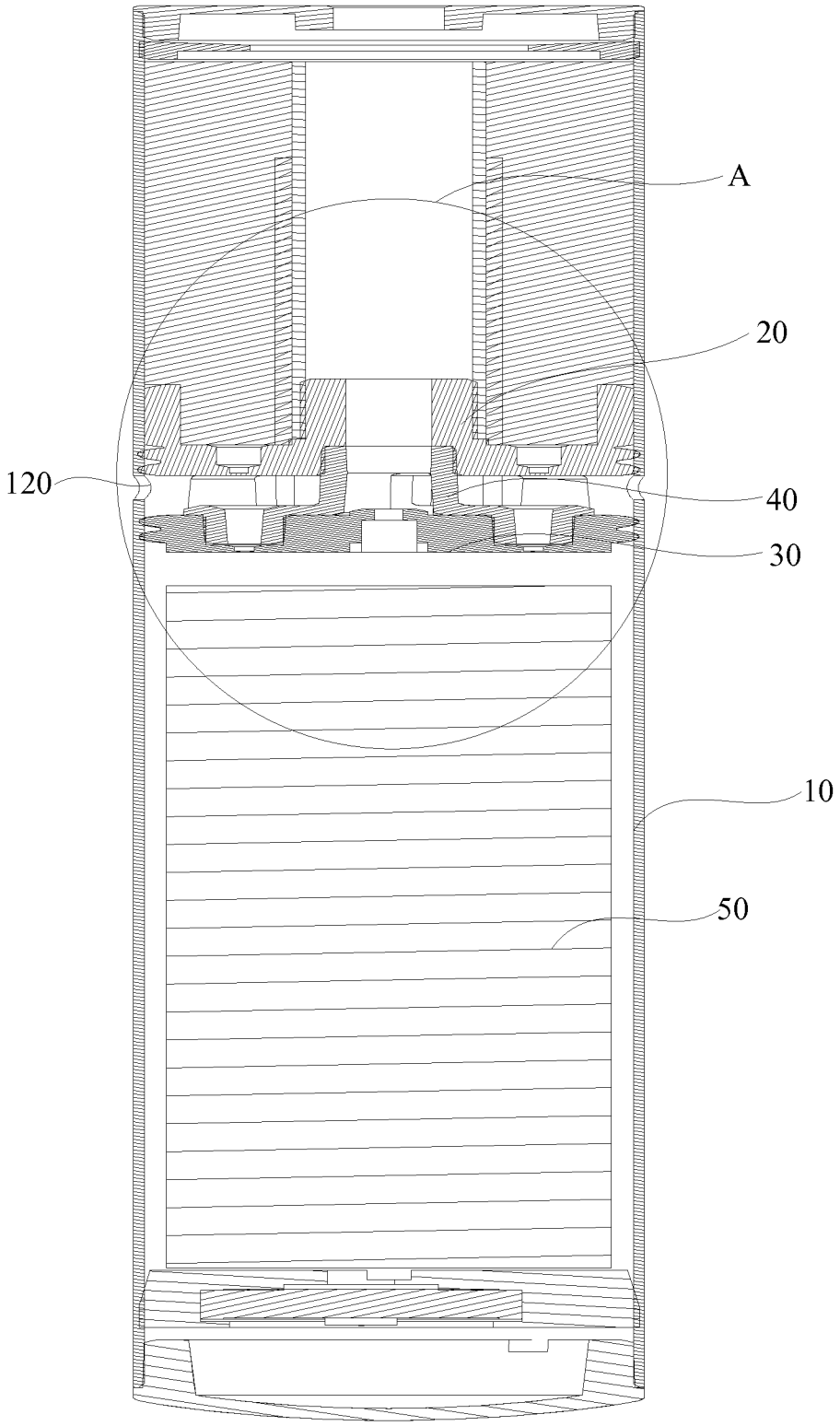
FIG. 1 is a cutaway view of an electronic cigarette of a first embodiment of the present invention.
Figure 2:
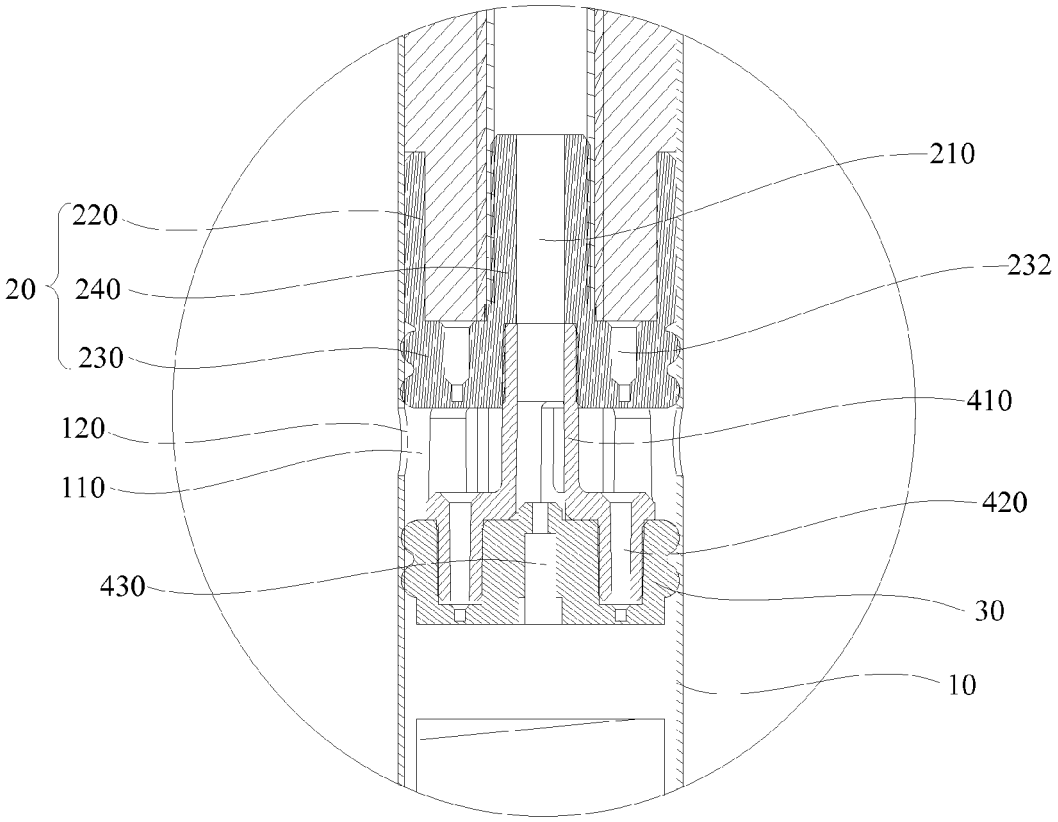
FIG. 2 is an enlarged view of A portion shown in FIG. 1.

Referring to FIG. 1 and FIG. 2, a first embodiment of the present invention provides an electronic cigarette, which comprises a case 10, an atomizer seat 20, a battery 50, a bracket 40, and a sealing component 30. Wherein, the atomizer seat 20, the battery 50, the bracket 40 and the sealing component 30 are all accommodated in the case 10, the bracket 40 and the sealing component 30 are mounted between the atomizer seat 20 and the battery 50, one end of the bracket 40 is fixedly connected with the atomizer seat 20, the other end of the bracket 40 fits and is connected with the sealing component 30, and the sealing component 30 keeps a certain distance away from the battery 50.

An air inlet hole 120 is defined in a position of the case 10 corresponding to the bracket 40 , and the air inlet hole 120 is configured to enable outside air to enter the electronic cigarette.

Figure 3:
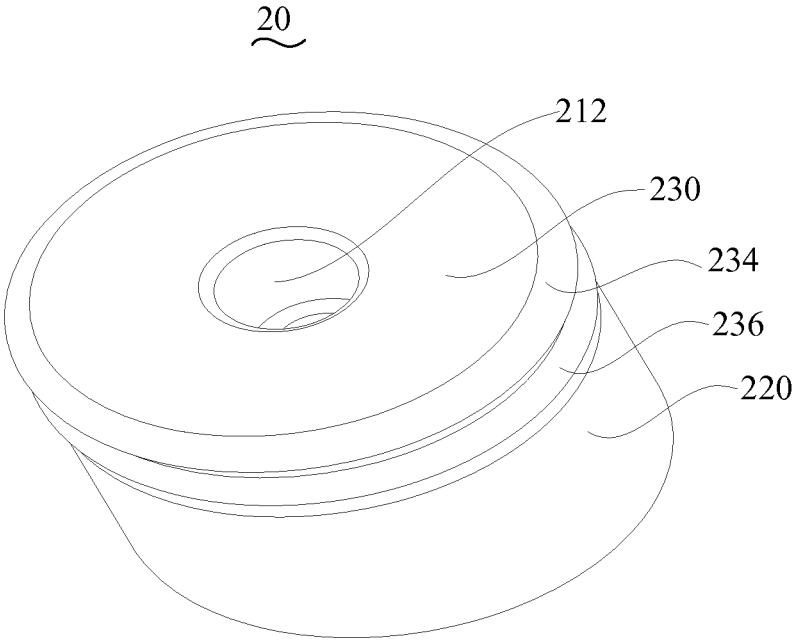
FIG. 3 is a first structural schematic view of an atomizer shown in FIG. 1.
Figure 4:
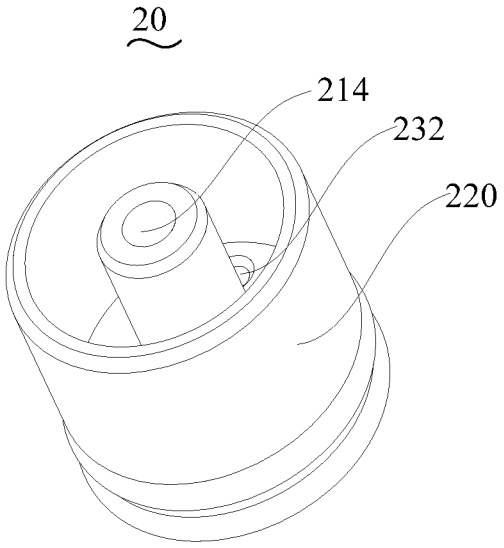
FIG. 4 is a second structural schematic view of the atomizer shown in FIG. 3.

Referring to FIG. 3 and FIG. 4, the atomizer seat 20 is substantially cylindrical and has one open end. The atomizer seat 20 comprises a hollow atomizer seat body 220, an atomizer seat cap 230, and a cylindrical center body 240. The atomizer seat body 220 is a cylinder with two opposite open ends, and the atomizer seat cap 230 covers at one end of the atomizer seat body 220 to form the atomizer seat 20 with the open end. The atomizer seat 20 is made of soft materials, such as any one or a mixture of polyvinyl chloride, polypropylene resin, and EVA.

A first connection hole 212 is defined in the atomizer seat cap 230. The center body 240 extends towards a direction that is away from the bracket 40 along an edge of the first connection hole 212, and the center body 240 is sleeved in the atomizer seat body 220 and is vertically connected with the atomizer seat cap 230. A diameter of the center body 240 is less than a diameter of the atomizer seat body 220, so that a certain gap is formed between the center body 240 and a side wall of the atomizer seat body 220. In this embodiment, the center body 240 is a hollow cylinder with two opposite open ends, and thus defines a second connection hole 214 going through the center body 240. The first connection hole 212 and the second connection hole 214 communicate with each other to form a first through hole 210.

Two wire holes 232 are defined in the atomizer seat cap 230. The two wire holes 232 are arranged on two opposite sides of the first connection hole 212 respectively, so that wires can pass through the wire holes 232 to be connected with two poles of the battery 50.

A third annular flange 234 and a fourth annular flange 236 are arranged on the outer side of the atomizer seat cap 230. The third ring flange 234 and the fourth ring flange 236 are separated from each other, and both the third ring flange 234 and the fourth ring flange 236 form interference fit with the case 10. Because the atomizer seat cap 230 and an inner surface of the case 10 form interference fit, tobacco tar within the atomizer seat 20 can be effectively prevented from flowing into a chamber of the battery, and a first protective layer configured to prevent the tobacco tar from leaking is formed.

Figure 5:
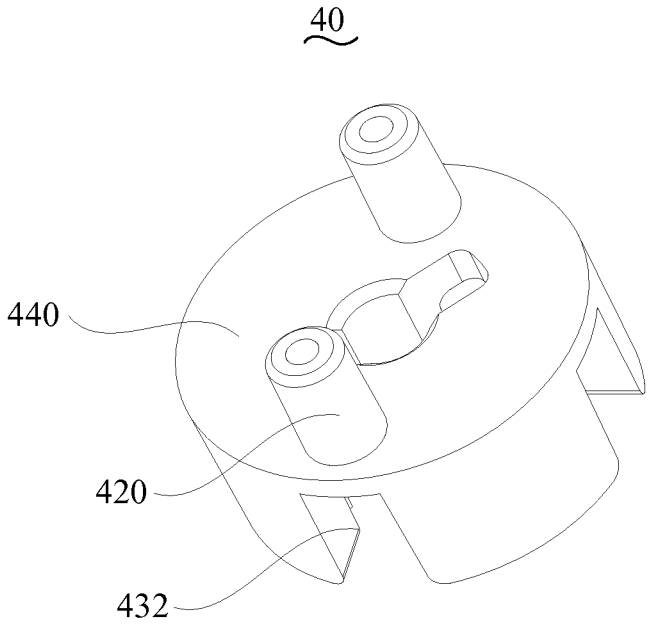
FIG. 5 is a first structural schematic view of a bracket shown in FIG. 1.
Figure 6:
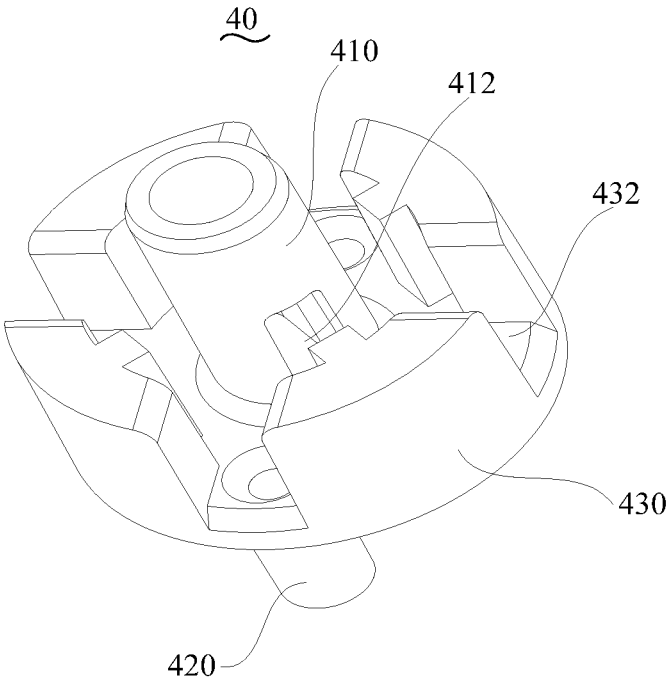
FIG. 6 is a second structural schematic view of the bracket shown in FIG. 5.

Referring to FIG. 5 and FIG. 6, the bracket 40 is substantially cylindrical, and is configured for supporting and fixing the atomizer seat 20 and the sealing component 30. A width of the bracket 40 is less than a width of the case 10, so that a gap 110 for air circulation is formed between the bracket 40 and the case 10. Thus, air flow is enabled to flow into the atomizer freely, and users' demands can be met.

The bracket 40 comprises a sleeve body 430, a sleeve cap 440, an extension part 410 and a clamping part 420. The sleeve body 430 is a hollow cylinder with two opposite open ends, and the sleeve cap 440 covers at one end of the sleeve body 430. Grooves 432 are defined in the sleeve body 430 separately, so that the sleeve body 430 is divided into several parts. The grooves 432 are configured for air circulation.

The extension part 410 is a hollow cylinder extending along an axis of the sleeve cap 440. The extension part 410 is perpendicular to the sleeve cap 440 and contacts with the sleeve cap 440. A position of the sleeve cap 440 corresponding to the hollow cylindrical portion of the extension part 410 is also hollow. A certain distance is provided between the extension part 410 and the sleeve body 430 for air circulation. Particularly, the extension part 410 extends to one side near the atomizer seat 20 and extends out of the sleeve body 430 for a certain distance, that is, a length of the extension part 410 is greater than a length of the sleeve body 430. A side wall of the extension part 410 is also provided with a second through hole 412 for air circulation, and the second through hole 412 communicates with the hollow interior of the extension part 410.

The clamping part 420 is also a hollow cylinder that is perpendicular to the sleeve cap 440 and contacts with the sleeve cap 440. However, the extending direction of the clamping part 420 is opposite to that of the extension part 410, that is, the clamping part 420 is positioned at the side near the sealing component 30. In this embodiment, the number of the clamping part 420 is two, and the two clamping parts 420 are configured at positions of the sleeve cap 440 corresponding to the grooves 432. A diameter of each of the clamping parts 420 is less than a diameter of the extension part 410. Furthermore, the two clamping parts 420 are arranged symmetrically relative to an axis of the extension part 410.

In this embodiment, the bracket 40 is an integral structure, which needs simple processing technology and achieves good overall effect. The bracket 40 is made of hard plastic materials, such as any one or a mixture of ABS, PC, and PA.

Figure 7:
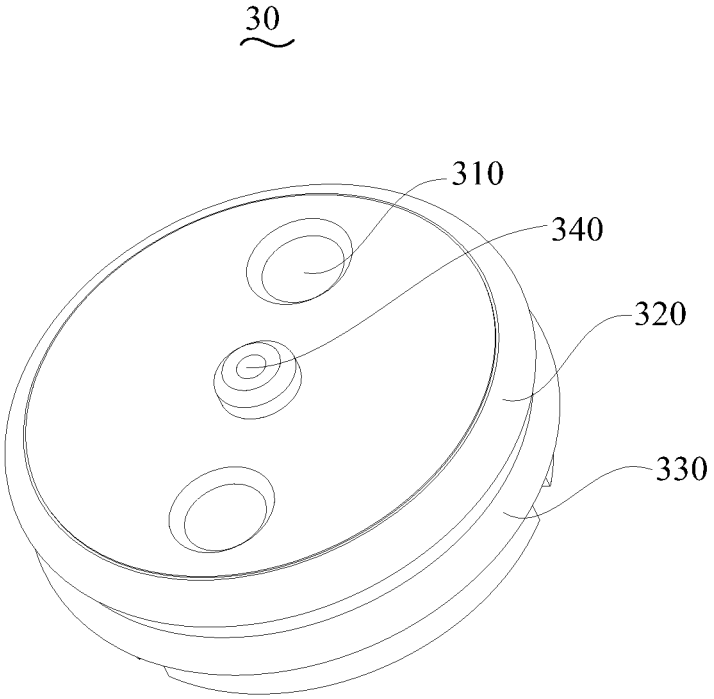
FIG. 7 is a structural schematic view of a sealing component shown in FIG. 1.

Referring to FIG. 7, the sealing component 30 is configured for fixing the bracket 40, and the sealing component 30 and the inner surface of the case 10 form interference fit to prevent tobacco tar leakage. Recesses 310 and a third through hole 340 are defined in the sealing component 30. One end of the sealing component 30 partially sinks to form the recesses 310, and sizes of the recesses 310 match with that of the clamping parts 420, so that the clamping parts 420 can be fixed in the recesses 310. The third through hole 340 is configured for enabling gas flowing from ends of the battery 50 to pass. The third through hole 340 communicates with the hollow internal structure of the extension part 410, and is coaxial with the extension part 410. In this embodiment, the number of the recesses 310 is two, and the recesses 310 correspond to two clamping parts 420 one-to-one. The third through hole 340 is positioned between the two recesses 310. The Sealing component 30 is made of soft material, such as any one or a mixture of polyvinyl chloride, polypropylene resin, and EVA.

A first annular flange 320 and a second annular flange 330 are separately formed on an outer side of the sealing component 30. The first annular flange 320 is formed at one side of sealing component 30 near the bracket 40, and both the first annular flange 320 and the second annular flange 330 form interference fit with the case 10. Because the sealing component 30 and the case 10 form interference fit, tobacco tar within the atomizer seat 20 is effectively prevented from flowing into the chamber of the battery 50, and a second protective layer configured to prevent tobacco tar leakage is formed. Compared with the prior art, both the atomizer seat 20 and the sealing component 30 form interference fit with the case 10, thereby forming double protection to prevent tobacco tar from leaking and flowing into the chamber of the battery 50.

In the electronic cigarette of the present invention, the atomizer seat 20 and the case 10 form interference fit, the extension part 410 of the bracket 40 is inserted into the first connection hole 212 of the atomizer seat cap 230, the sealing component 30 and the case 10 form interference fit, and the recesses 310 of the sealing component 30 and the clamping part 420 of the bracket 40 fixedly engage with each other. Thus, the atomizer seat 20, the bracket 40, and the sealing component 30 are fixed together. When the atomizer seat 20, the bracket 40, and the sealing component 30 are fixed together, the air inlet 120 of the case 10, the gap 110, the grooves 432, the second through hole 412, and the first through hole 210 are communicated to form a first air circulation channel 210, that is, outside air can enter the electronic cigarette via a center of the case 10. The third through hole 340 of the sealing component 30 is communicated with the first through hole 210 to form a second air circulation channel, so that air entering from one end of the lamp cap of the electronic cigarette can circulate in the electronic cigarette. By forming the first air circulation channel and the second air circulation channel, atomized smoke can be rapidly brought to a suction nozzle and inhaled by a user, and the user's experience is improved.

On the other hand, two ends of the bracket 40 are respectively inserted into the atomizer seat 20 and the sealing component 30. When the assembly of the electronic cigarette is completed, the atomizer seat 20, the sealing component 30 and the bracket 40 are combined into a whole, which increases the guiding length of the electronic cigarette. Because the bracket 40 is made of hard materials, the atomizer seat 20 and the sealing component 30 can be effectively prevented from leaning, and the leak-proof effect is excellent. Furthermore, both the atomizer seat 20 and the sealing component 30 form interference fit with the case 10, which forms double protection to prevent tobacco tar leakage Thus, the occurrence of tobacco tar leakage is prevented, and users' experience is improved.

Figure 8:
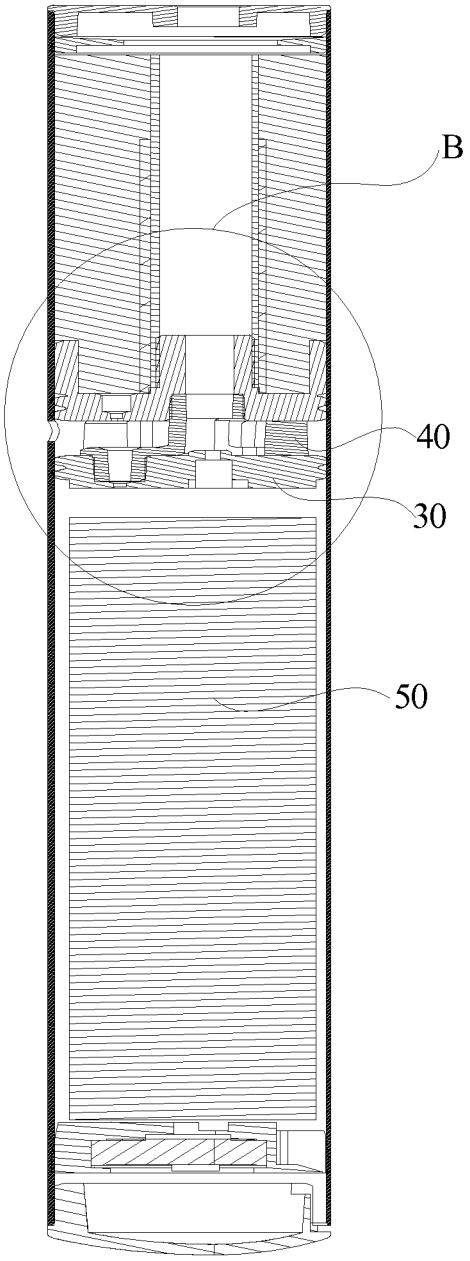
FIG. 8 is a cutaway view of an electronic cigarette of a second embodiment of the present invention.
Figure 9:
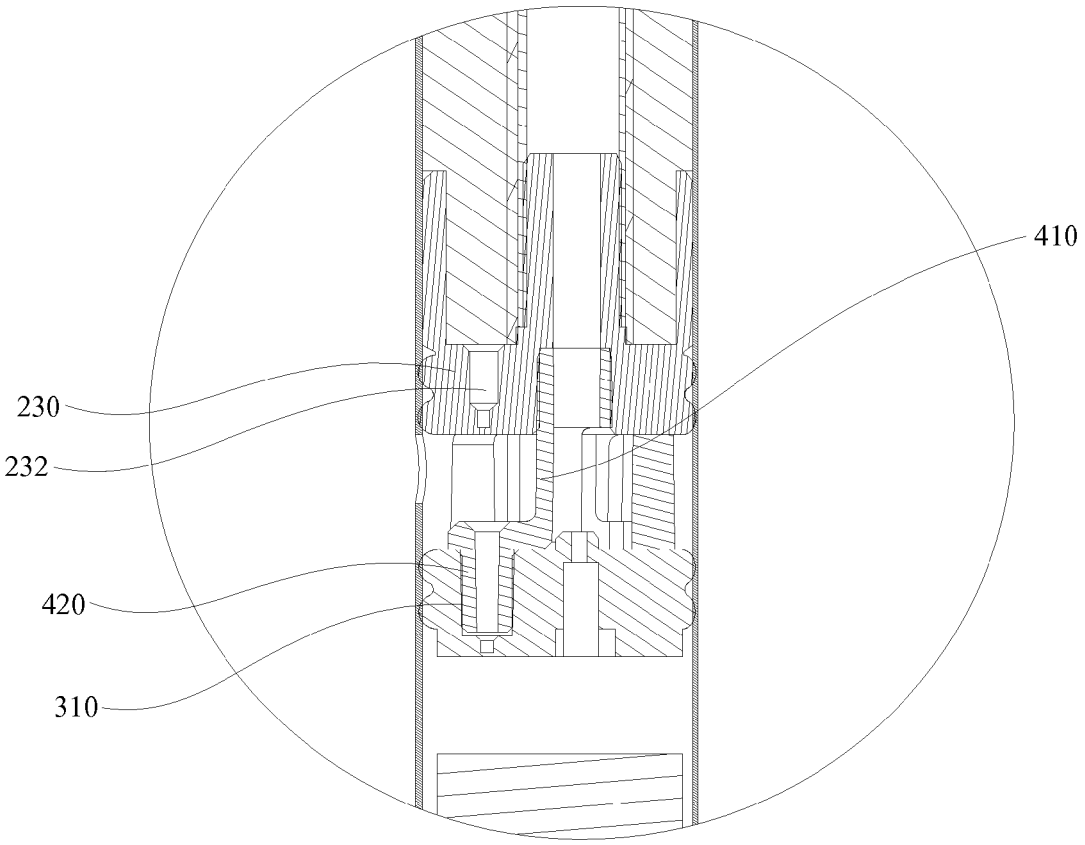
FIG. 9 is an enlarged view of B portion shown in FIG. 8.

Referring to FIG. 8 and FIG. 9, an electronic cigarette provided by a second embodiment of the present invention differs from the electronic cigarette of the first embodiment in that: only one clamping part 420 is formed on the bracket 40, correspondingly, only one recess 310 configured for receiving the clamping part 420 is defined in the sealing component 30. The atomizer seat cap 230 is provided with only one wire hole 232, and the wire hole 232 and the clamping part 420 are positioned on a same side of the extension part 410. Both two wires connecting with the battery 50 go through the wire hole 232, or only one of the two wires go through the wire hole 232. Other connections and structures are similar to that of the first embodiment, and are not repeated here.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. A leakage prevention structure for an electronic cigarette, comprising an atomizer seat defining a first through hole, a bracket, and a sealing component, wherein an extension part corresponding to the first through hole is formed at one side of the bracket facing the atomizer seat, and the extension part is inserted in the first through hole to prevent the atomizer seat and the sealing component from leaning, and the sealing component is sleeved in an electronic cigarette body and cooperates with an inner surface of the electronic cigarette body to form interference fit;

wherein a first annular flange and a second annular flange are separately formed on a periphery of the sealing component, and the first annular flange is formed on a side of the sealing component that is closest to the bracket, and the first annular flange and the second annular flange form interference fits with the electronic cigarette body respectively;

wherein the bracket comprises a sleeve body, a sleeve cap, and a clamping part, and the sleeve body is a hollow cylinder with two opposite open ends, and the sleeve cap covers at one end of the sleeve body; grooves are defined in the sleeve body to divide the sleeve body into several parts; the bracket is configured to support and fix the atomizer seat and the sealing component, and a width of the bracket is less than a width of the electronic cigarette body to enable a gap for air circulation to be formed between the bracket and the electronic cigarette body;

wherein the extension part is a hollow cylinder extending along an axis of the sleeve cap, and the extension part is perpendicular to the sleeve cap; portion of the sleeve cap corresponding to the hollow cylinder portion of the extension part is also hollow; a certain distance is configured between the extension part and the sleeve body for air circulation;

wherein the clamping part is formed at a side of the bracket near the sealing component, and the clamping part is also a hollow cylinder and perpendicular to the sleeve cap, with the extending direction being opposite to that of the extension part;

wherein the sealing component is configured to fix the bracket, and the sealing component and the inner surface of the electronic cigarette body form interference fit to prevent tobacco tar leakage; recesses and a third through hole are defined in the sealing component, and the recesses are configured to accommodate the clamping part; one end of the sealing component partially sinks to form the recesses, and the size of the recesses match with that of the clamping parts to ensure the clamping parts are fixed in the recesses; the third through hole is configured to enable gas flow from an end of a battery to pass through, and the third through hole communicates with the hollow internal structure of the extension part, and is coaxial with the extension part;

wherein the atomizer seat is substantially cylindrical and has one open end, and the atomizer seat comprises a hollow atomizer seat body, an atomizer seat cap defining a first connection hole and covering on one end of the atomizer seat body, and a cylinder extending towards a direction that is away from the bracket along an edge of the first connection hole, and a second connection hole is defined in the cylinder; the first connection hole and the second connection hole are communicated to form the first through hole; a third annular flange and a fourth annular flange are separately formed on a periphery of the atomizer seat cap, and both the third annular flange and the fourth annular flange form interference fits with a case respectively; and wherein the atomizer seat and the electronic cigarette body form interference fit, and the extension part of the bracket is inserted into the first connection hole of the atomizer seat cap; the sealing component and the electronic cigarette body form interference fit, and the recesses of the sealing component and the clamping part of the bracket fixedly engage with each other in order to enable the atomizer seat, the bracket, and the sealing component being sequentially fixed together.

2. The leakage prevention structure for the electronic cigarette according to claim 1, wherein both the number of the clamping part and the number of the recess are two, the two clamping parts are symmetrically positioned relative to an axis of the extension part, and the recesses and the clamping parts are arranged in an one-to-one relationship.

3. The leakage prevention structure for the electronic cigarette according to claim 1, wherein the atomizer seat cap further defines two wire holes, and the two wire holes are positioned on two opposite sides of the first connection hole respectively.

4. The leakage prevention structure for the electronic cigarette according to claim 1, wherein, a second through hole for air circulation is defined in a side wall of the extension part.

5. The leakage prevention structure for the electronic cigarette according to claim 1, wherein an air inlet hole is defined in a portion of electronic cigarette body corresponding to the gap, and the air inlet hole, the gap, the grooves, a second through hole, and the first through hole are communicated to form a first air flow channel.

6. The leakage prevention structure for the electronic cigarette according to claim 1, wherein a length of the sleeve body is less than a length of the extension part.

7. The leakage prevention structure for the electronic cigarette according to claim 1, wherein the third through hole, the extension part, and the first through hole are communicated to form a second air flow channel.

8. The leakage prevention structure for the electronic cigarette according to claim 7, wherein the third through hole is positioned between the two recesses, and the third through hole and the extension part are set coaxially.

9. The leakage prevention structure for the electronic cigarette according to claim 1, wherein the bracket is made of plastic materials.

10. The leakage prevention structure for the electronic cigarette according to claim 1, wherein both the atomizer seat and the sealing component are made of soft rubber materials.

11. An electronic cigarette, comprising the leakage prevention structure for the electronic cigarette in claim 1.

* * * * *